US005219433A

United States Patent [19]

Zaruba et al.

[11] Patent Number: 5,219,433

[45] Date of Patent: Jun. 15, 1993

[54] SEQUENTIAL RESPONSE DETERMINING QUESTION GAME

[75] Inventors: John V. Zaruba, Oak Park, Ill.; Michael Gorker, Sharon, Mass.; John R. Sutyak, Wakefield, Mass.; Douglas Harrison, Newburyport, Mass.

[73] Assignee: Breslow, Morrison, Terzian & Associates, Inc., Chicago, Ill.

[21] Appl. No.: 833,841

[22] Filed: Feb. 7, 1992

[51] Int. Cl.[5] ..... A63F 9/18

[52] U.S. Cl. ..... 273/432; 273/429

[58] Field of Search ..... 273/429, 430, 432, 440

[56] References Cited

U.S. PATENT DOCUMENTS 3,339,921 9/1967 Glass et al. .

3,841,629 10/1974 Barlow ..... 273/440

4,895,364 1/1990 Martel et al. ..... 273/430 X

OTHER PUBLICATIONS

Trivial Pursuit Game ©1990.

Family Feud Game ©1990.

*Primary Examiner*—V. Millin

*Assistant Examiner*—Raleigh W. Chiu

*Attorney, Agent, or Firm*—Dick and Harris

[57] ABSTRACT

A game, in which a question is simultaneously posed to all of the players, includes a device for determining which of a number of players is the first to correctly answer, or to most closely correctly answer the question. Emanating from a central hub are a number of biased pivoting arms that are related at one end to the hub. A response to a posed question can be indicated adjacent the free end of each of the arms. The arms are all biased to pivot the free end toward the hub to facilitate the positive identification of the sequential order of the answers. Each player restrains the free end of an assigned arm until the player has indicated an answer to the question. Selected ones of up to six arms may be connected to the hub to accommodate differing numbers of players. A readily erasable writing surface is carried adjacent the free end of each arm on which players mark the answer. An elongated implement used to eraseably mark on the writing surface also may be used to lock the arms in an extended position against the bias. Preferably, the game includes a supply of question cards which only require a short answer, such as a numeral or a letter of the alphabet.

14 Claims, 1 Drawing Sheet

HOW MANY SIGNS OF THE ZODIAC?
12
14a
WHAT PERCENT OF THE HUMAN BODY IS WATER?
62
14b
WHAT WAS THE SCARLET LETTER?
A
14c
HOW MANY STRIKES MAKE AN OUT?
3
14d

SEQUENTIAL RESPONSE DETERMINING QUESTION GAME

BACKGROUND OF THE INVENTION

1. Field of the Invention

This invention relates generally to games and more particularly to games in which players are required to be the first to correctly answer a question.

2. Background Art

Games, such as "TRIVIAL PURSUIT," in which players attempt to correctly answer various questions have long been popular. In some of such prior art games, such as both the "FAMILY FEUD" television game show and board game, a question is simultaneously posed to a number of players, each of which strive to be the first to correctly answer the question. Proper selection of the questions helps to minimize an adult's or an older child's educational advantages. However, it is also important in such games to try and minimize the physical advantanges that a stronger or louder participant may have in being recognized as first. Glass et al. U.S. Pat. No. 3,339,921 issued Sep. 5, 1967 discloses a card game having a device for determining which player was last to react to one of the players being entitled by card play to make the first move. The device disclosed in Glass et al. includes a base with four, evenly spaced apart, outwardly extending, pivoted levers. Each lever is normally disposed in a upwardly inclined position and engages a moveable tab normally disposed in a generally vertical position. Upon a player striking the lever, the tab is pivoted downwardly into the central portion of the base. There remains a need, however, for games and for devices facilitating their play, providing for fair and positive identification of the winner where a question is simultaneously posed to a number of players.

SUMMARY OF THE INVENTION

The present invention is concerned with providing a game that includes a device for determining which of a number of players is the first to correctly answer, or to most closely correctly answer, a question simultaneously posed to all of the players. Emanating from the center of the device are a number of biased pivoting arms that are related at one end to the center. A response to a posed question can be indicated adjacent the free end of each of the arms. The arms are all biased to pivot the free end toward the center for positive determination of the sequential order of the response of each of the players. Each player restrains the free end of an assigned arm until the player has indicated an answer to the question. Adjacent the free end may be a readily erasable writing surface on which players mark the answer. An elongated working implement may also cooperate to lock the arm in an extended position against the bias. Selected ones of a number of identical arms may be removeably connected to the center to accommodate differing numbers of players. The game includes a supply of questions that only require short answers, preferably a letter of the alphabet or numerals.

BRIEF DESCRIPTION OF THE DRAWINGS

For a better understanding of the present invention, reference may be had to the accompanying drawings in which.

DETAILED DESCRIPTION

Figures 1, 2, 3, 4, 5, 6, 7, 8, 9:
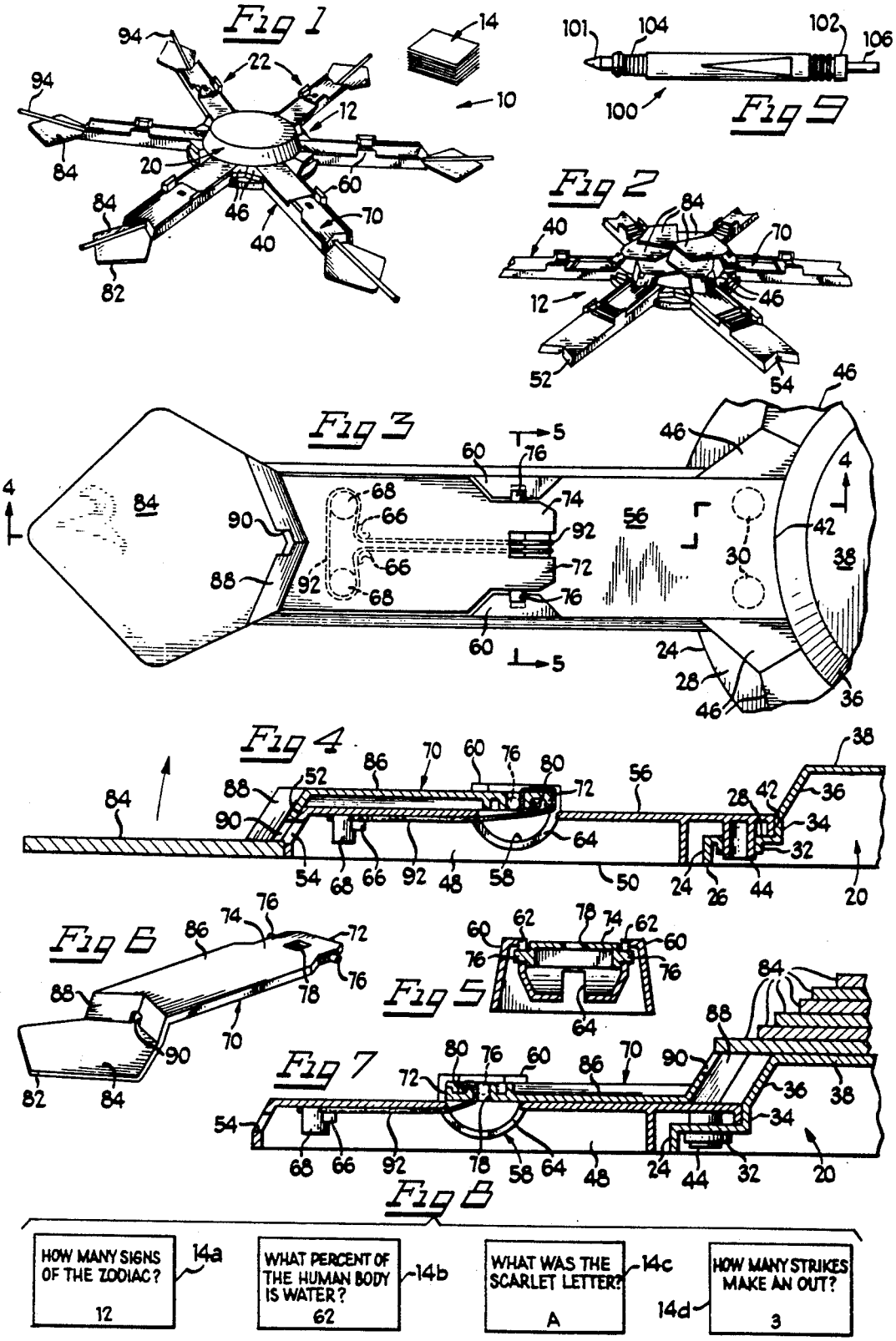
FIG. 1 is a perspective view of an embodiment of the present invention.
FIG. 2 is a perspective view of the same embodiment showing all of the response paddles pivoted onto the central hub.
FIG. 3 is an enlarged scale, fragmentary, top plan view showing one arm and an associated portion of the central hub in the extended position shown in FIG. 1
FIG. 4 is a sectional view taken generally along line 4—4 of FIG. 3.
FIG. 5 is a sectional view taken generally along line 5—5 of FIG. 3.
FIG. 6 is a perspective view of one of the pivoting paddle members.
FIG. 7 is a vertical sectional view taken generally along the center of the same arm assembly and associated portion of the central hub shown in FIG. 3 but with the paddle portion pivoted onto the central hub as in FIG. 2.
FIG. 8 is a top plan view of exemplary question card faces.
FIG. 9 is a top plan view showing a marking implement for the invention in greater detail.

Referring now to the drawings in which like parts are designated by like reference numerals throughout the several views, there is shown in FIG. a game 10 including a determining device 12 and a plurality of question cards 14. Determining device 12 includes a central hub 20 from which each of six paddle arm assemblies 22 extend. Each of the paddle arm assemblies are identical and accordingly, only one of them will be further described in detail, it being understood that each of the other arm assemblies are constructed and operate in the same manner.

Central hub 20, which is molded of a super high impact polystyrene such a Mobil MX 5400 or an equivalent, has an outer lower peripheral wall 24 with a bottom peripheral edge 26 that is generally planar and supports the hub upon a flat playing surface such as a table or floor. Extending inwardly from the top of wall 24 is a generally flat annular ledge 28. Disposed around ledge 28, at substantially thirty degree intervals, are twelve substantially identical holes 30 of a predetermined diameter. As is best shown in FIG. 4, each of holes 30 includes a downwardly depending tubular wall 32 within the generally hollow interior of central hub 20. At the inboard edge of ledge 28 another wall 34 extends upwardly to join a further upwardly and inwardly extending angled wall 36 Generally coplanar with ledge 28 and atop wall 36 is a substantially flat, central top 38.

Each paddle arm assembly 22 includes a base member 40 is molded of the same super high impact polystyrene such as Mobil MX 5400 or an equivalent as is central hub 20. Base member 40 is elongated and has an arcuate end 42 adjacent which the base member is to be connected to central hub 20. Adjacent arcuate end 42 are a pair of spaced apart, depending, substantially identical posts 44, each having a predetermined outer diameter that fits snuggly within one of holes 30 for positive but removeable connection of the base member to the hub.

The two posts of each base member are spaced apart so as to fit within a selected pair of holes 30 on ledge 28. Accordingly, the first one of arms 22, or more particularly base members 40, to be connected or attached to hub 20 may be attached at any selected position. Any number of the remaining five arm assemblies are then connected to the central hub. If it is desired to play the game with less than six players, only the required number of arm assemblies 22 may be connected to the central hub. Thus, if it is desired to attach only four of the arm assemblies one of holes 30 is left vacant between adjacent arm assemblies so that the four arm assemblies are then evenly spaced apart. Similarly, if two openings 30 are left vacant on either side of the initially connected arm assembly, three arm assemblies are equally spaced around the central hub.

As is best illustrated in FIG. 3, connected arcuate end 42 conforms with the outer curved peripheral of wall 34 of central hub 20. Engagement of arcuate end 42 with wall 34, together with the engagement between the pair of spaced apart posts 44 in the respective holes 30 of ledge 26, preclude substantially radial movement of the arm assembly with respect to the hub. Adjacent end 42, base member 40 has a pair of opposed, outwardly laterally projecting angled flanges 46. As is best illustrated in FIGS. 1, 2 and 3, the outer edges of lateral flanges 46 are angled so that when all six arm assemblies 22 are connected to hub 20, the lateral flanges of each arm assembly abut the respective flanges of adjoining arm assemblies. Such abuttment of adjoining flanges further precludes any substantially radial movement of the arm with respect to the hub.

Base member 40 has a depending peripheral wall 48 with a generally planar bottom edge 50. As is best shown in FIGS. 4 and 7, when base member 40 is connected to hub 20, bottom edge 50 of the base member and bottom edge 26 of the hub are substantially coplanar. Opposite connected end 42 is a generally V-shaped end 52 having a generally centrally disposed aperture 54. A generally planar wall extends along the top of base member 40. Disposed between ends 42 and 52 is a semi-cylindrical recess 58 with the axis of the recess being generally transverse to the elongated direction of the base member. Spaced apart on each side of recess 58 is a side wall 60 with a U-shaped journal bracket or socket 62. In the bottom of recess 58, generally centrally disposed along the center of elongated base member 40, is a slot 64. Within the interior of base member 40, depending from top wall 56 between end 54 and recess 58, are spaced apart guides 66. Also within the interior of base member 40, depending from top wall 56 between end 54 and guides 66, are further spaced apart anchor bosses 68.

Mounted on base member 40 for pivotal movement with respect to both the base member and central hub 20 is a pivoting paddle member 70 which is molded of a copolymer polypropelene such as Himont 7523 or an equivalent. Pivoting paddle member 70 has a mounted end 72 with a narrowed portion 74. Extending laterally outwardly on each side of narrowed portion 74 is a trunnion 76. Generally centrally disposed in narrowed portion 74 is a transverse slot 78. As is best shown in FIG. 7, on the other side of the portion of the wall proximal end 72 that defines slot 78 is an anchor pin 80.

Adjacent the opposed free end 82 of pivoting paddle member 70 is a generally planar paddle portion 84 disposed at a level below that of the major portion 86 of pivoting paddle member 70. Extending between paddle portion 84 and major portion 86, generally disposed between free end 82 and recess 58, is an intermediate V-shaped wall 88 that conforms to, and aligns with, V-shaped end 52 of base member 40. Extending through V-shaped wall 88 is a generally centrally disposed aperture 90. As is best illustrated in FIG. 4, aperture 90 aligns with aperture 54 of base member 40 when pivot paddle member 70 is mounted on, and is in an extended position in relation to, base member 40. Each of trunnions 76 are received in a respective journal bracket 62 to mount pivot paddle member 70 on base member 40 for pivotal movement in relation to both the base member and central hub 20. Semi-cylindrical recess 58 accommodates the swing of the projecting portion of member 70 adjacent mounted end 72 as member 70 pivots between the extended position illustrated in FIGS. 1 and 4 and the biased pivoted position illustrated in FIGS. 2 and 8.

An elastic or rubber band 92 is secured between anchor bosses 68 depending from top wall 56 of base member 40 and anchor pin 80 on pivoting paddle member 70. As shown in FIGS. 3, 4 and 7, rubber band 92 passes around anchor bosses 68, between guides 66, through slot 64 in semi-cylindrical recess 58, around mounted end 72 of pivot paddle member 70, and through slot 78 in member 70 to anchor pin 80. When pivoting paddle member 70 is in the extended position, as shown in FIG. 4, rubber band 92 is stretched from 250% to 400% so as to bias member 70 to pivot up and toward central hub 20 to the position shown in FIG. 7. With rubber band 92 so greatly stretched, it functions like a metal spring to snap paddle member 70 forward. Upon release, pivoting paddle member 70 will be pivoted by the bias of band 92 to the position illustrated in FIGS. 2 and 7. Whether paddle 84 of released member 70 will rest directly upon top 38 of central hub 20 or instead rest atop the paddle portion of another, previously released member 70 depends on when it was released in relation to the other pivoting paddle members. Thus, device 12 provides a positive determination of the sequential order of players, responses to a question.

Paddle portion 84 provides an easily erasable writing surface for a wax marker such as elongated marking implement 94. As an alternative, removeably adhering sheets of paper, such as the "POST-IT" brand note pads, could be placed on the paddle portions and the answer written on such paper with an ordinary pen or pencil. In addition to its use in indicating an answer to a posed question, elongated implement 94 also functions to lock pivoting paddle member 70 in the extended position as shown in FIG. 1. For this locking function, elongated implement 94 must have a maximum cross sectional dimension less than that of the diameter of aligned apertures 54 and 90. Elongated implement 94 is, as illustrated in FIG. 1, inserted through aligned apertures 54 and 90 to lock pivoting paddle member 7 in the extended position against the bias of band 92.

FIG. 9 shows a preferred elongated marking implement 100 for use with this invention. A "CRAYOLA" brand crayon 101 is used to erasably indicate responses directly on the surface of polypropelene paddle 84. Crayon 101 is housed in a generally cylindrical barrel 102 having a collet 104 at its forward end for retaining crayon 101 in the extended position shown in FIG. 9. Extending rearwardly from the back end of implement 100 is a cylindrical extension 106 that has a reduced diameter as compared to barrel 102. The maximum cross sectional diameter of extension 106 is less than the diameter of aligned apertures 54 and 90 so that extension 106 may be inserted to lock pivoting paddle member 70 in the extended position.

Included with the game are a plurality of questions contained on cards 14. The correct answer to each of the questions should be short and it is preferred that the correct answers consist of a letter of the alphabet or numerals. Exemplary questions are indicated on the faces of cards 14*a*, 14*b*, 14*c* and 14*d* shown in FIG. 8. If desired, questions can be divided into various categories such as sports and games; science and nature; measurements; entertainment; particular geographic areas and the like. During play, the players take turns in reading the questions or, alternatively, a player may be designated to sit out a round of play and serve to just pose questions to the other players.

Prior to a question being read, each of the responding players removes the elongated implement locking the player's assigned pivoting paddle member in its extended position and manually restrains the free paddle end against the bias of the rubber band. As soon as a player writes, what the player believes to be the correct answer to the question posed, the free end is released and pivots toward the central hub. When all of the players have released their respective answer paddles, the paddles are manually pivoted back from the hub and their sequential order and response are noted. If the first released paddle contains the correct answer, the player having written that answer and released the paddle is the winner.

Should the first released response be incorrect, each subsequently released paddle is checked for its response and the next paddle found to have the right answer determines the winner. However, in the event that none of the players have correctly answered the question, the answers are again examined to determine which player was the first to provide a response that is closest to the correct answer. Accordingly, the chance of a tie occurring is totally eliminated.

While a particular embodiment of the present invention has been shown and described with some alternatives, further variations and modifications will occur to those skilled in the art. It is intended in the appended claims to cover all such variations and modifications as fall within the true spirit and scope of the present invention.

What is claimed as new and desired to be secured by Letters Patent is:

1. A game for a number of players comprising in combination:

a plurality of question cards;

means facilitating the indication of a response to a selected one of the question cards;

a device for determining the sequential order of response of each of the players to a question simultaneously posed to the players responding to the question;

the determining device including a central hub;

an arm extendable from the central hub for each of the players responding to the selected one of the questions;

each arm having an end adjacent the central hub and a free end positionable away from the central hub;

means biasing each free end toward the central hub; and at least part of the means for facilitating the indication of a response being carried by each arm adjacent the free-end.

2. The game of claim 1 in which the part of the means facilitating the indication of a response comprises a readily erasable writing surface.

3. The game of claim 1 including means locking each arm in an extended position against the biasing means.

4. The game of claim 3 in which:

the means for facilitating the indication of a response includes an elongated marking implement for each player; and each player's elongated marking implement is also part of the means locking a respective arm in the extended position.

5. The game of claim 1 in which:

each arm includes an elongated base member and an elongated pivoting member;

the base member has a connected end adjacent to which the base member is connected to the central hub and an opposed end spaced from the connected end;

the pivoting member has a mounted end adjacent to which the pivoting member is mounted on the base member between the connected end and the opposed end of the base member;

the pivoting member has a free end spaced from the mounted end;

the pivoting member is mounted for pivotal movement relative to the base member; and the biasing means biases pivotal movement of the pivoting member toward the central hub.

6. The game of claim 5 including means locking the pivoting member, against the biasing means, in an extended position with respect to the base member and the central hub.

7. The game of claim 6 in which:

the opposed end of the base member includes an end wall;

the means locking the pivoting member in an extended position with respect to the base member and the central hub includes an aperture in the end wall; and the game includes an elongated response marking implement having at least a portion of one end of a maximum predetermined cross sectional dimension adapted to fit into the opening to lock the pivoting member in the extended position.

8. The game of claim 7 in which:

the pivoting member has an intermediate wall, between the free end and the mounted end, that aligns with the end wall of the base member; and the means locking the pivoting member in an extended position with respect to the base member and the central hub also includes an aperture in the intermediate wall that aligns with the aperture in the end wall to receive the elongated implement in locking engagement when the pivoting member is in the extended position.

9. The game of claim 5 including:

trunnions carried by one of the base member or the pivoting member; and spaced apart journal sockets carried by the other of the base member or the pivoting member for receiving the trunnions to pivotally support the pivoting member upon the base member.

10. The game of claim 1 further comprising:

a connected end on each arm adjacent which the arm is connected to the central hub; and means cooperating to connect the arm to the central hub.

11. The game of claim 10 in which the means cooperating to connect the arm to the central hub preclude substantial radial movement of the arm relative to the hub.

12. The game of claim 11 in which the means cooperating to connect the arm to the central hub include a pair of spaced apart posts carried by one of the arm or the central hub and a pair of aligned post receiving holes carried by the other of the arm or the central hub.

13. The game of claim 12 in which:

the hub carries a number of one of the posts or holes for receiving the posts; and each of the posts or holes for receiving the posts carried by the central hub are radially equidistantly spaced around the hub in relation to each adjoining one of the posts or holes for receiving the posts.

14. The game of claim 1 in which the correct answers to question cards consist of a letter of the alphabet or numerals.

* * * * *